US010334947B1

(12) United States Patent
Eilmus et al.

(10) Patent No.: US 10,334,947 B1
(45) Date of Patent: Jul. 2, 2019

(54) SINK SHELF

(71) Applicant: Kohler Co., Kohler, WI (US)

(72) Inventors: Niels J. Eilmus, Sheboygan, WI (US); Evan M. Grybush, Port Washington, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/985,417

(22) Filed: May 21, 2018

(51) Int. Cl.
*A47B 55/02* (2006.01)
*A47B 96/02* (2006.01)
*E03C 1/186* (2019.01)

(52) U.S. Cl.
CPC ..... *A47B 55/02* (2013.01); *A47B 96/021* (2013.01); *E03C 1/186* (2013.01)

(58) Field of Classification Search
CPC ..... A47B 55/02; A47B 96/021; A47B 43/003; A47B 96/02; A47B 96/022; A47B 96/025; A47B 43/006; A47B 2051/005; A47F 5/0892; A47F 5/08; A47F 5/0025; A47J 47/16; A47J 47/20; A47K 1/12; E03C 1/186; E03C 1/32; E03C 1/33
USPC ..... 211/153, 117, 90.01, 88.01, 90.02, 150; 108/26, 181, 182, 65, 66, 90; 312/408, 312/410
See application file for complete search history.

(56) References Cited

U.S. PATENT DOCUMENTS 573,835 A * 12/1896 Taylor ..... A47G 25/743 211/119
1,576,607 A 3/1926 Hasskarl
1,853,989 A 4/1932 Gottlieb
1,879,888 A 9/1932 Sieber et al.
1,922,585 A * 8/1933 Hoffstetter ..... F24C 15/16 126/337 A
1,925,371 A * 9/1933 Charter ..... A47B 96/025 126/339
1,985,658 A * 12/1934 Heise ..... A47J 47/20 211/86.01
1,997,432 A * 4/1935 Replogle ..... F25D 25/02 126/337 R
2,008,315 A * 7/1935 Schmidt ..... F25D 25/02 211/113

(Continued)

FOREIGN PATENT DOCUMENTS

CN 303715553 6/2016
GB 2370496 6/2005

(Continued)

OTHER PUBLICATIONS

The Container Store; Expandable under sink organizer; Jan. 10, 2018; 2 pgs.

(Continued)

*Primary Examiner* — Jennifer E. Novosad
(74) *Attorney, Agent, or Firm* — Foley & Lardner LLP

(57) ABSTRACT

A sink shelf assembly that includes a first shelf member configured to mount underneath a sink and comprising a front surface, a back surface, two side surfaces interconnecting the front and back surfaces, and a recess extending inwardly from the back surface between the two side surfaces; and a second shelf member removably received in the recess of the first shelf member in a coupled position and removed from the recess in a decoupled position to allow routing of plumbing through the recess without obstruction from the first shelf member.

16 Claims, 3 Drawing Sheets

(56) References Cited

U.S. PATENT DOCUMENTS 2,071,900 A * 2/1937 Procter ..... A47B 88/407 211/153
2,169,763 A * 8/1939 Kucher ..... F25D 25/02 211/153
2,262,578 A * 11/1941 Ellis ..... F25D 25/021 211/150
2,294,155 A * 8/1942 Boddy ..... F25D 25/02 160/222
2,319,470 A * 5/1943 Nobles ..... F25D 25/02 211/153
2,352,345 A * 6/1944 Rundell ..... F25D 25/02 211/153
2,403,164 A * 7/1946 Ahrens ..... A47B 49/00 108/104
2,458,332 A * 1/1949 Boschan ..... A47B 43/003 24/370
2,564,478 A * 8/1951 Harbison ..... F25D 25/02 211/153
2,895,617 A * 7/1959 Orser ..... F25D 25/02 108/134
2,903,137 A * 9/1959 Brown ..... A47B 55/02 211/104
2,994,439 A 8/1961 Kolkey
3,266,484 A * 8/1966 Carpenter ..... F24C 15/16 126/337 R
3,450,025 A * 6/1969 Fleming ..... F24C 7/06 126/19 R
3,694,046 A 9/1972 Hasso
3,943,581 A * 3/1976 Reyes ..... A47K 1/08 4/630
4,221,441 A 9/1980 Bain
4,241,963 A 12/1980 Siedel
5,152,595 A 10/1992 Zaccone
5,197,611 A * 3/1993 Walton ..... A47K 10/22 211/106
6,029,580 A * 2/2000 Alfonso ..... F16M 13/02 108/26
6,341,704 B1 * 1/2002 Michel, Jr. ..... A47J 47/20 211/119
6,349,717 B1 * 2/2002 Thompson ..... F24C 15/16 126/333
6,409,031 B1 * 6/2002 Wynne ..... A47B 55/02 108/181
6,497,331 B1 * 12/2002 Morandi ..... A47B 43/00 211/149
D470,353 S * 2/2003 Mikich ..... D6/513
6,663,204 B2 * 12/2003 Atalla ..... A47B 96/025 211/153
6,688,478 B2 * 2/2004 Miller, Jr. ..... A47F 1/12 211/118
7,316,326 B2 * 1/2008 Kim ..... A47B 46/005 211/150
7,798,341 B2 * 9/2010 Richardson ..... A47F 5/0892 211/119
D628,856 S 12/2010 Wang
7,878,344 B2 * 2/2011 Martin ..... F24C 15/16 126/337 A
8,590,714 B1 * 11/2013 Osuna-Valerio ..... E05B 73/00 109/50
9,033,438 B2 * 5/2015 Kelly ..... F25D 25/024 108/102
9,301,671 B2 4/2016 Gruppen
2002/0023888 A1 * 2/2002 Wynne ..... A47B 55/02 211/119
2002/0043189 A1 * 4/2002 Mikich ..... A47B 5/00 108/149
2005/0218096 A1 * 10/2005 Dunn ..... A47B 55/02 211/153
2006/0027105 A1 * 2/2006 Woon ..... F24C 15/16 99/426
2007/0151018 A1 7/2007 Palkon
2008/0047915 A1 * 2/2008 Parks ..... F24C 15/16 211/153
2009/0127216 A1 * 5/2009 Young ..... A47F 5/0892 211/113
2010/0275368 A1 11/2010 Miller et al.
2013/0032560 A1 * 2/2013 Gregory ..... A47B 43/006 211/153
2014/0284295 A1 * 9/2014 Taylor ..... A47B 45/00 211/153
2014/0291264 A1 * 10/2014 Lewis ..... A47B 57/18 211/88.01

FOREIGN PATENT DOCUMENTS

JP 3004815 11/1994
JP 2013118894 6/2013

OTHER PUBLICATIONS

Lynk Professional Roll Out Under Sink Cabinet Organizer; Jan. 10, 2018; 9 pgs.
Simple Houseware Under Sink 2 Tier Expandable Shelf Organizer Rack; Jan. 10, 2018; 7 pages.

* cited by examiner

SINK SHELF

BACKGROUND

The present disclosure relates generally to the field of sink shelves. More specifically, the present disclosure relates to a sink shelf assembly configured to affix underneath a sink that includes a removable shelf member to allow routing of plumbing and other objects.

SUMMARY

At least one embodiment of this application relates to a sink shelf assembly that includes a first shelf member configured to mount underneath a sink and having a front surface, a back surface, two side surfaces interconnecting the front and back surfaces, and a recess extending inwardly from the back surface between the two side surfaces; and a second shelf member removably received in the recess of the first shelf member in a coupled position and removed from the recess in a decoupled position to allow routing of plumbing through the recess without obstruction from the first shelf member.

At least one embodiment relates to a sink shelf assembly having a first shelf member and a second shelf member, wherein the first shelf member is configured to mount to an underside of a sink. The first shelf member has a front surface, a back surface, and two parallel side surfaces, and includes an opening disposed therein to allow plumbing to vertically pass through. The sink shelf assembly further including a second shelf member, wherein the second shelf member is removably received within the opening of the first shelf member when there is no plumbing that passes through the opening.

At least one embodiment relates to a sink shelf assembly that includes a sink basin, a plurality of arms, a first shelf member, and a second shelf member. The sink basin includes a front, a back configured to mount to a wall, two sides interconnecting the front and the back, and a bottom interconnecting the front, the back, and the two sides. Each arm of the plurality of arms extends downwardly from the sink basin, and each arm has an upper end that is coupled to an underside of the bottom of the sink basin. The first shelf member extends between two side surfaces and has an opening disposed between the two side surfaces, wherein each arm has a lower end that is coupled to one of the two side surfaces of the first shelf member. The second shelf member is removably received within the opening of the first shelf member in a coupled position, and the second shelf member is separated from the first shelf member in a decoupled position to allow plumbing or other objects to pass through the opening.

At least one embodiment relates to a sink shelf assembly having a sink basin, a plurality of vertically extending arms, a first shelf member, and a second shelf member. The sink basin includes a front surface, a back surface, and two side surfaces, and attaches to a wall on a back surface. Each arm of the plurality of vertically extending arms is coupled to an underside of the sink basin. The first shelf member includes an opening disposed therein to allow plumbing to vertically pass through. A lower end of each arm of the plurality of vertically extending arms is coupled to the first shelf member. The second shelf member is removably received within the opening of the first shelf member when there is no plumbing that passes through the opening, and may be removed from the opening to allow plumbing to pass through unobstructedly.

At least one embodiment relates to a sink apparatus that includes a sink basin, first and second sink legs, and first and second shelf members. The sink basin includes a front wall, a back wall, two side walls, and a bottom. The first and second sink legs are spaced apart from another and each leg is coupled to an underside of the bottom of the sink basin. The first shelf member is located underneath and offset from the bottom, and the first shelf member extends between the two side walls and between the front and back walls with an opening disposed therein. The second shelf member is removably received within the opening of the first shelf member in a coupled position and is removed from the opening of the first shelf member in a decoupled position to allow plumbing or other objects to route through the opening.

At least one embodiment relates to an apparatus having a sink basin, a pair of sink legs, a first shelf member, and a second shelf member. The sink basin includes a front surface, a back surface, and two side surfaces, and attaches to a wall on the back surface. The pair of sink legs is disposed along the front surface under the sink basin. The first shelf member mounts to an underside of the sink basin. and includes an opening disposed therein to allow plumbing to vertically pass through. The second shelf member is removably received within the opening of the first shelf member when there is no plumbing that passes through the opening.

This summary is illustrative only and is not intended to be in any way limiting. Other aspects, inventive features, and advantages of the devices and/or processes described herein, as defined solely by the claims, will become apparent in the detailed description set forth herein, taken in conjunction with the accompanying figures, wherein like reference numerals refer to like elements.

DETAILED DESCRIPTION

Prior to turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1:
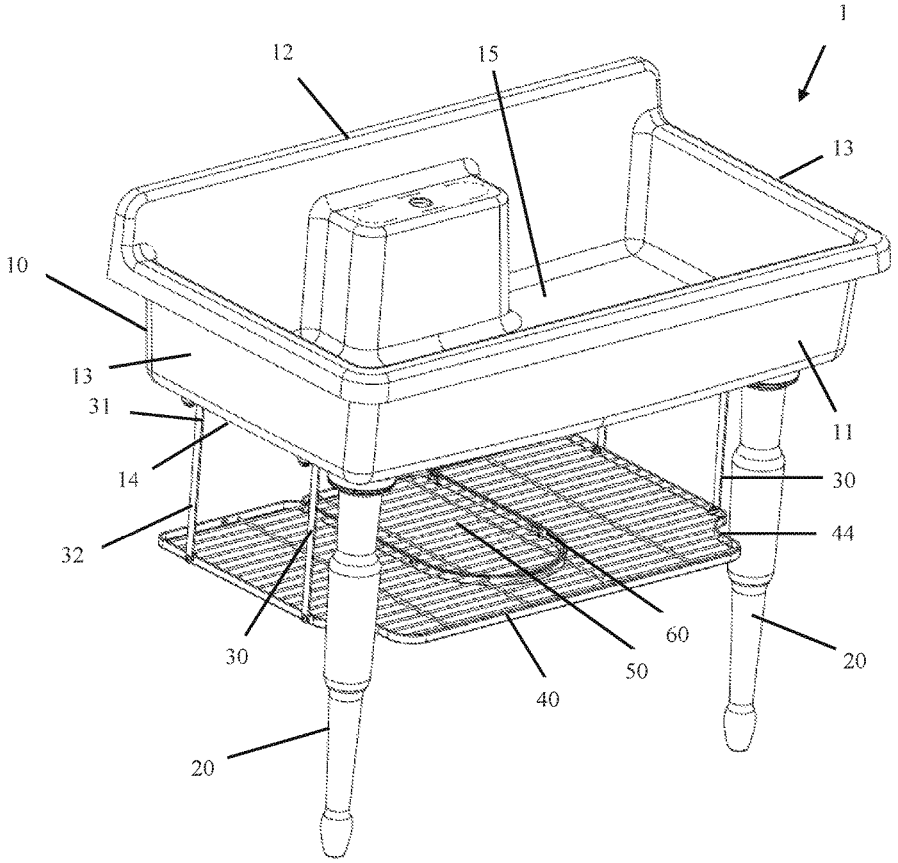
FIG. 1 is a perspective view of the sink shelf affixed underneath a sink, according to an exemplary embodiment of this disclosure.

FIG. 1 illustrates a sink 1 that includes a sink basin 10, a pair of sink legs 20 supporting the sink basin 10, a first shelf member 40 (e.g., body, shelf, etc.), a plurality of arms 30 shown extending vertically to support the first shelf member 40, and a second shelf member 50 (e.g., body, shelf, etc.), which is detachably coupled to the first shelf member 40. Although, the sink 1 shown is configured for use as a kitchen sink, the sink shelf assemblies disclosed herein may be used with bathroom sinks. Further, although, the sink 1 is shown as farm-style kitchen sink including legs 20 that support the sink basin 10 such as by contacting the kitchen floor, the sink shelf assemblies disclosed herein may be used with other types of kitchen sinks, such as apron-front sinks, which do not need the support legs.

Also shown in FIG. 1, the sink basin 10 has a front 11 (e.g., front wall) having a front surface, a back 12 (e.g., back wall) having a back surface, and two parallel sides 13 (e.g., side walls) having side surfaces forming a generally rectangular shape (when viewed from above). The front 11, the back 12, and the sides 13 are interconnected with a bottom 15 to form a generally open top cuboidal basin for holding water. The sink basin 10 can be mounted to a wall or other support structure, such as using one or more fasteners. The back 12 (e.g., back surface) of the illustrated sink basin 10 is configured to couple or mount to a wall or other supporting structure. In this way, the wall may structurally support the sink basin 10. The sink basin 10 may be made of any suitable material (e.g., porcelain, ceramic, stainless, other steels, etc.).

Each sink leg 20 is coupled to an underside 14 of the sink basin 10 at a front outer corner and extends vertically downward to the floor. As shown, each sink leg 20 is located proximate the associated side 13 of the sink basin 10. In other words, the sink legs 20 are disposed in the front outer corners of the sink basin 10. Each sink leg 20 is configured to structurally support the sink basin 10 and, as shown, each sink leg 20 has a generally cylindrical shape. However, each sink leg 20 can have any configuration (e.g., shape, height, etc.). Further, each sink leg 20 can be made of or include any suitable material, such as metal or wood.

The illustrated sink 1 includes four arms 30 extending downwardly (e.g., vertically) from the sink basin 10 to support the first shelf member 40. As shown, two arms 30 are disposed along each of the two sides 13 and underneath an underside 14 of the sink basin 10. The arms 30 can be made of or include any suitable material (e.g., metal or plastic) and are configured to couple the first shelf member 40 to the sink basin 10, such as by hanging the first shelf member 40 below the sink basin 10. For example, an upper end 31 of each arm 30 can be coupled to the underside 14 and/or one side 13 of the sink basin 10 and may extend generally vertically downward, such that a lower end 32 of each arm 30 is coupled with the first shelf member 40. Thus, the arms 30 can be used to fixedly hang and support the first shelf member 40 below the sink basin 10. In this way, the first shelf member 40 is detachably mountable to the sink 1.

Also shown in FIG. 1, the first shelf member 40 is disposed below and is coupled to the sink basin 10 using the arms 30. The first shelf member 40 can be made of or include any suitable material (e.g., metal or plastic). The illustrated first shelf member 40 has a top surface on which items can be stored or supported. For example, a user may store toiletries or cleaning supplies on the first shelf member 40. Beneficially, this allows a user to optimize storage under the sink 1. The outer perimeter of the first sink member 40 may have the same general shape (e.g., profile) as the sink basin 10, except the first sink member 40 may include rounded (e.g., concave) portions 44 for receiving part of a leg 20. As shown in FIG. 1, the first shelf member 40 has a rounded portion 44 located at the each of the two front corners (i.e., where the front 11 and the sides 13 meet). Since the sink legs 20 are disposed below the sink basin 10 in the areas, the rounded portions 44 enable the sink legs 20 to extend from the sink basin 10 to the floor without obstruction from the first sink member 40.

Figure 2:
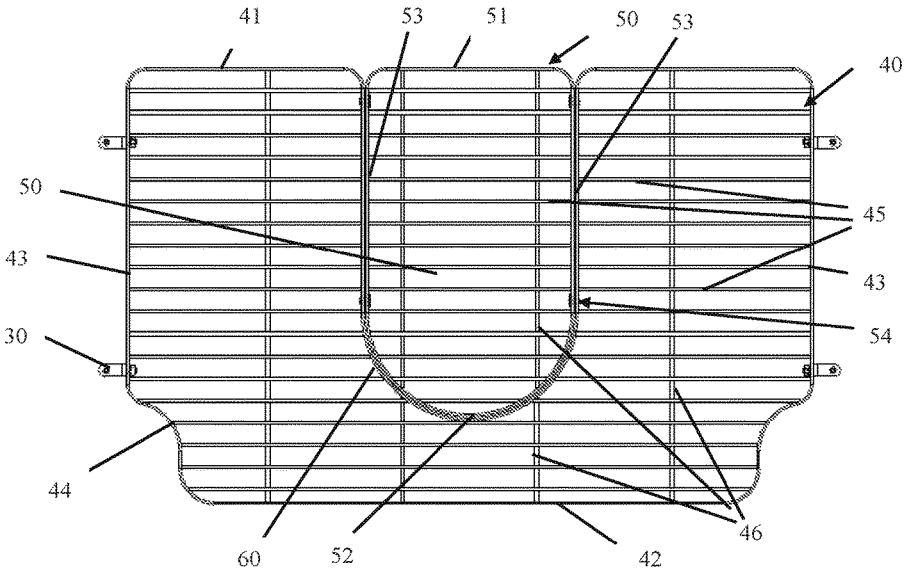
FIG. 2 is a top view of the sink shelf shown in FIG. 1.

As shown in FIG. 2, the outer perimeter of the first shelf member 40 has a back surface 41, a front surface 42, two side surfaces 43 extending between the back and front surfaces 41, 42, a rounded portion 44 extending between the front surface 42 and each side surface 43, and an opening 60 (e.g., notch, recess, etc.). The first shelf member 40 may extend generally the same width and/or length as the sink basin 10 (i.e., have the same general dimensions as the sides 13 of the sink basin 10 and the front and/or back surfaces 11, 12 of the sink basin 10). However, due to the rounded portions 44, the front surface 42 of the first shelf member 40 may be shorter than the front 11 of the sink basin 10.

Figure 3:
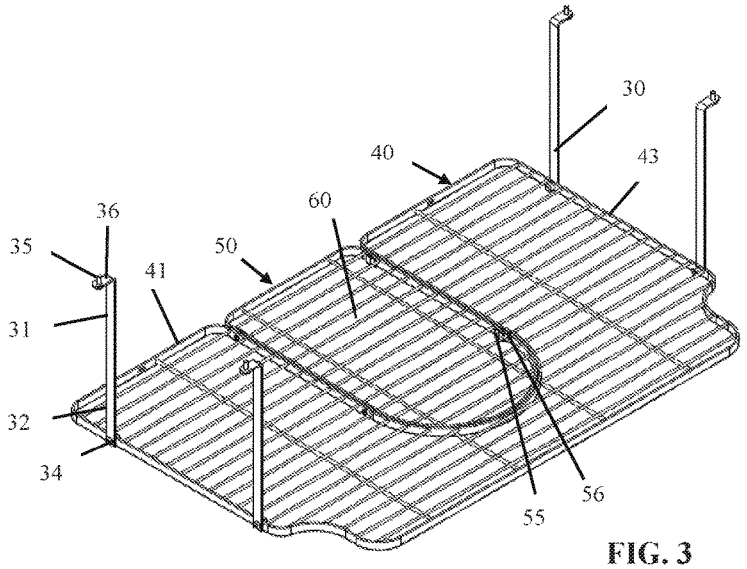
FIG. 3 is a perspective view of the sink shelf shown in FIG. 1.
Figure 4:
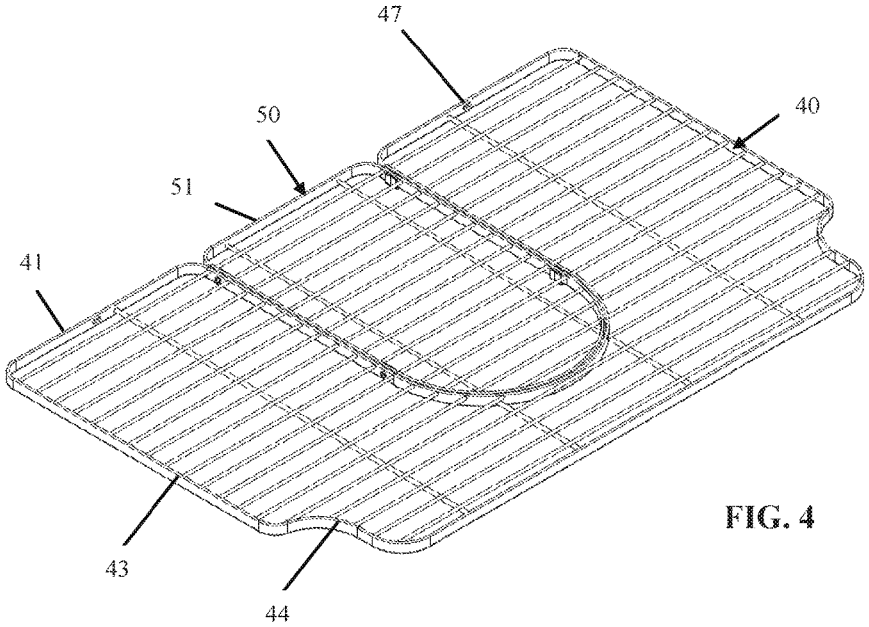
FIG. 4 is another perspective view of the sink shelf shown in FIG. 1 with the mounting arms removed for clarity.

The opening 60 in the first shelf member 40 allows for plumbing (and other elements) to route or pass through (e.g., pass vertically through). By way of example, plumbing associated with the drain pipe (e.g., p-trap) or water introduction (e.g., hot water line, cold water line), among other things, as well as routing electricity, docking components, etc. for the sink 1 can be routed through the opening 60, such as from the sink basin 10 to the floor or a wall. The opening 60 extends forward from a back surface 41 of the first shelf member 40 and may be disposed substantially centrally along the back surface 41 (e.g., approximately midway between the two side surfaces 43), such as to locate the opening 60 below the drain of the sink. As illustrated in FIGS. 2-4, the opening 60 is defined by a U-shape portion along the profile of the first shelf member 40. Although, the configuration (e.g., size, shape, etc.) of the opening 60 may be tailored to allow specific plumbing (or other elements) to pass through, while still maximizing the amount of available surface area on the top surface of the first shelf member 40.

The second shelf member 50 is configured to be removably (e.g., detachably) received within the opening 60 of the first shelf member 40, such as when there is no plumbing that passes through the opening. In other words, the second shelf member 50 may be coupled to and received within the opening 60 of the first shelf member 40 in a first or coupled position or use (e.g., when it will not obstruct any plumbing), and the second shelf member 50 may be removed from the opening 60 (e.g., decoupled from the first shelf member 40) in a second or decoupled position or use to allow plumbing to pass through the opening 60 without obstruction. In this way, beneficially, the entire top surface of both the first shelf member 40 and the second shelf member 50 may be utilized for storing items in the first position (e.g., when plumbing is not present), and additionally, if plumbing is present, the second shelf member 50 is conveniently removed and stored aside so the plumbing can be routed through the opening 60. This arrangement advantageously provides a user more versatility to change the plumbing and/or route other features/elements associated with the sink 1, as well as increase the storage area depending on the routing of the plumbing/other features/elements. This provides added flexibility with improved storage below the sink.

Also shown in FIGS. 2-4, the outer perimeter (e.g., profile) of the second shelf member 50 complements (i.e., is substantially the same as) the shape as the perimeter of the opening 60 of the first shelf member 40. The illustrated second shelf member 50 includes a back surface 51 that is flush with or parallel to the back surface 41 of the first shelf member 40, a front surface 52, and two side surfaces 53 extending between the front and back surfaces 52, 51. As shown, the second shelf member 50 has a bullet shape, with a semi-circular (e.g., round) front surface 52, generally parallel side surfaces 53, and a back surface 51 that is generally perpendicular to the side surfaces 53, in order to complement the associated part of first shelf member 40 defining the opening 60. The first shelf member 40 and the second shelf member 50 may be coupled together by way of a coupling mechanism 54, which may, for example, include a fastener 55 (e.g., screw, bolt, rivet, etc.), and/or any other suitable fastening method. A fastener 55 can be received within an aperture in each of shelf member 40, 50, such as along the side surfaces 53. Each coupling mechanism 54 can, optionally, include a bracket 56, a tab, a clip, or other feature that extends away from the first shelf member 40 (e.g., into the opening) to support and/or receive part of the second shelf member 50.

As previously stated, the first shelf member 40 and second shelf member 50 each have a top surface on which items may be stored. The top surface of the first shelf member 40 and second shelf member 50 can be coplanar and, as shown, each is defined by a (first) plurality of wires 45 extending parallel to one another laterally between the side surfaces 43, 53 of the shelf members 40, 50. The wires 45 can be made of or include any suitable material (e.g., metal). Each shelf member 40, 50 may, optionally, include a (second) plurality of wires 46 (e.g., support wires). As shown, the support wires 46 extend perpendicular to the wires 45 between the back surface 41 and the front surface 42 of the first shelf member 40 as well as between the back surface 51 and the front surface 52 of the second shelf member 50. The support wires 46, if provided, are coupled to the wires 45 forming a grid pattern. For example, the support wires 46 can be disposed below the wires 45, such that an underside of each wire 45 rests upon a top surface of one or more support wires 46. In this way, the support wires 46 may provide structural support to the wires 45 to increase the weight carrying capacity of the shelf member.

FIG. 3 illustrates the four arms 30 coupled to the outer perimeter of the first shelf member 40. Specifically, the lower end 32 of each arm 30 is coupled to a side surface 43 of the first shelf member 40 by way of a fastener 34. As non-limiting examples, each arm 30 can be mounted to the outer perimeter of the first shelf member 40 using one or more screws or bolts. However, it should be appreciate that other fasteners 34 can be utilized. Similarly, the upper end 31 of each arm 30 is configured to couple to the underside 14 of the sink basin 10 by way of one or more additional fasteners 35. In the embodiment shown, the fastener 35 couples a bracket 36, which is shown as a flange extending from the upper end 31 in a direction perpendicular to the longitudinal direction of the associated arm 30. The illustrated bracket 36 is configured to abut the underside 14 of the sink basin 10 and is affixed (e.g., clamped) thereto using the fastener 35. The bracket 36 can be separate from or integrally formed with the arm 30.

FIG. 4 illustrates the first shelf member 40 and second shelf member 50 coupled together, but with the arms 30 omitted. As previously described, when installed below the sink basin 10, the back surface 41 of the first shelf member 40 and the back surface 51 of the second shelf member 50 may abut a wall. In the illustrated embodiment, the first shelf member 40 has a mounting hole 47 in the back surface 41 to couple the first shelf member 40 directly to the wall adjacent the back surface 41. Mounting the first shelf member 40 directly to the wall advantageously provides additional structural support. The mounting hole 47 receives a fastener (e.g., screw, bolt, other fastener) to fixedly couple the first shelf member 40 to the wall. The back surface 41 can be fixed to the wall using another fastening method (e.g., adhesive, a support bracket, such as an L-bracket).

In one or more alternate embodiments, one or more mounting holes 47 can be disposed in one or both of the side surfaces 43, such as to fixedly couple to another object (e.g., cabinet, wall, etc.). Accordingly, the first shelf member 40 can be mounted using the one or more mounting holes 47 alone (i.e., as a substitute for) or in combination with the arms 30. For example, the first shelf member 40 can be mounted below a sink basin 10 using only the mounting holes 47. In yet other alternative embodiments, one or more mounting holes 47 can be disposed elsewhere, such as in the rounded portion 44 of the first shelf member 40 to couple the first shelf member 40 directly to the sink legs 20 for additional support. Often, sink basins (e.g., apron-front sinks) are received in and supported by cabinetry (i.e., one or more cabinets). In this instance, a first shelf member 40 may be coupled to a rear wall and/or one or more side walls of the cabinetry using one or more mounting holes 47.

In one or more alternate embodiments, the first shelf member 40 and/or second shelf member 50 can have a top surface that is solid or substantially solid. In other words, the plurality of parallel and perpendicular wires can be replaced with a top surface of the first shelf member 40 and/or the second shelf member 50 that is one solid surface.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled to each other, with the two members coupled with a separate intervening member and any additional intermediate members coupled with one another, or with the two members coupled together with an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIG- URES. It should be noted that the orientation of various elements may differ according to other exemplary embodiments, and that such variations are intended to be encompassed by the present disclosure.

It is important to note that the construction and arrangement of the shelf assembly as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, the position of elements may be reversed or otherwise varied, and the nature or number of discrete elements or positions may be altered or varied. Any element disclosed in one embodiment may be incorporated or utilized with any other embodiment disclosed herein. Although one example of an element that can be incorporated or utilized in another embodiment has been described above, it should be appreciated that other elements of the various embodiments may be incorporated or utilized with any of the other embodiments disclosed herein.

Other substitutions, modifications, changes and omissions may also be made in the design, operating conditions and arrangement of the various exemplary embodiments without departing from the scope of the present invention. For example, any element (e.g., arm, shelf member, fastener, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A sink shelf assembly comprising:

a first shelf member configured to mount underneath a sink and comprising a front surface, a back surface, two side surfaces interconnecting the front and back surfaces, and a recess extending inwardly from the back surface between the two side surfaces; and a second shelf member removably received in the recess of the first shelf member in a coupled position and removed from the recess in a decoupled position to allow routing of plumbing through the recess without obstruction from the first shelf member;

wherein the second shelf member includes two side surfaces that are detachably coupled to two inner side surfaces of the first shelf member in the coupled position, and wherein the two inner side surfaces define at least part of the recess;

wherein the second shelf member includes a back surface that is flush with the back surface of the first shelf member in the coupled position, and wherein the recess is located substantially centrally between the two side surfaces of the first shelf member;

wherein an outer perimeter of the second shelf member has a shape that complements a shape of the recess of the first shelf member;

wherein the outer perimeter of the second shelf member has a bullet shape having a rounded front surface extending from the two side surfaces of the second shelf member, which are parallel.

2. The sink shelf assembly of claim 1, further comprising a plurality of arms configured to fixedly couple the first shelf member to the sink, wherein each arm has a lower end, which is coupled to the first shelf member, and an upper end, which is configured to couple to the sink.

3. The sink shelf assembly of claim 2, wherein the lower end of each arm is coupled to one of the two side surfaces of the first shelf member, and the upper end of each arm is configured to couple to an underside of a basin of the sink.

4. The sink shelf assembly of claim 3, wherein the first shelf member comprises:

a plurality of parallel wires that define a top surface of the first shelf member and that extend between the two side surfaces of the first shelf member; and a plurality of parallel support wires that extend perpendicular to the plurality of parallel wires and between the front and back surfaces of the first shelf member.

5. The sink shelf assembly of claim 4, wherein the second shelf member comprises:

a plurality of parallel wires that define a top surface of the second shelf member and that extend between two side surfaces of the second shelf member; and a plurality of parallel support wires that extend perpendicular to the plurality of parallel wires of the second shelf member and between a front surface and a back surface of the second shelf member;

wherein the top surfaces are coplanar;

wherein the plurality of parallel wires of the first shelf member are aligned with the plurality of parallel wires of the second shelf member in the coupled position; and wherein the plurality of parallel support wires of the first shelf member are aligned with the plurality of parallel support wires of the second shelf member in the coupled position.

6. A sink shelf assembly comprising:

a sink basin comprising a front, a back configured to mount to a wall, two sides interconnecting the front and the back, and a bottom interconnecting the front, the back, and the two sides;

a plurality of arms that extend downwardly from the sink basin, wherein each arm has an upper end that is coupled to an underside of the bottom of the sink basin;

a first shelf member extending between two side surfaces and having an opening disposed between the two side surfaces, wherein each arm has a lower end that is coupled to one of the two side surfaces of the first shelf member; and a second shelf member that is removably received within the opening of the first shelf member in a coupled position and that is separated from the first shelf member in a decoupled position to allow plumbing to pass through the opening.

7. The sink shelf assembly of claim 6, wherein each shelf member comprises a top surface that is defined by a plurality of parallel wires that extend horizontally between left and right side members of the associated shelf member, and wherein the top surfaces are coplanar.

8. The sink shelf assembly of claim 7, wherein a first side surface of the two side surfaces is part of the left side member of the first shelf member, a second side surface of the two side surfaces is part of the right side member of the first shelf member, and at least two arms of the plurality of arms are coupled to each of the first and second side surfaces, each of which defines part of an outer perimeter of the first shelf member.

9. The sink shelf assembly of claim 8, further comprising:

a first leg coupled to and extending downwardly from a first corner of the underside of the bottom of the sink basin; and a second leg coupled to and extending downwardly from a second corner of the underside of the bottom of the sink basin;

wherein the first shelf member is coupled to each of the first and second legs.

10. The sink shelf assembly of claim 9, wherein the first shelf member comprises:

a front member extending parallel to the front of the sink basin;

a first concave portion located between the left side member and the front member, wherein the first concave portion is coupled to the first leg; and a second concave portion located between the right side member and the front member, wherein the second concave portion is coupled to the second leg.

11. A sink apparatus comprising:

a sink basin comprising a front wall, a back wall, two side walls, and a bottom;

first and second sink legs that are spaced apart from another and coupled to an underside of the bottom of the sink basin;

a first shelf member located underneath and offset from the bottom, the first shelf member extending between the two side walls and between the front and back walls with an opening disposed therein; and a second shelf member that is removably received within the opening of the first shelf member in a coupled position and that is removed from the opening of the first shelf member in a decoupled position to allow plumbing to route through the opening.

12. The sink of claim 11, wherein the first leg is coupled to and extending downwardly from a first corner of the underside of the bottom, the second leg is coupled to and extending downwardly from a second corner of the underside of the bottom, and the first shelf member is coupled to each of the first and second legs.

13. The sink of claim 12, wherein the first shelf member comprises:

a front member extending parallel to the front wall;

a rear member extending parallel to the rear wall;

a first side member extending parallel to at least one of the two side walls;

a second side member extending parallel to at least one of the two side walls;

a first concave portion located between the first side member and the front member, wherein the first concave portion receives part of the first leg; and a second concave portion located between the second side member and the front member, wherein the second concave portion receives part of the second leg.

14. The sink of claim 13, wherein the first leg is coupled directly to the first concave portion and the second leg is coupled directly to the second concave portion.

15. The sink of claim 14, wherein an outer perimeter of the first and second shelf members in the coupled position is substantially the same as an outer perimeter of the sink basin, the opening in the first shelf member is U-shaped, and the U-shaped opening extends forward from the rear member and is located centrally between the first and second side members.

16. The sink of claim 13, further comprising:

a first arm having an upper end, which is coupled to the bottom of the sink basin, and a lower end, which is coupled to the first side member of the first shelf member; and a second arm having an upper end, which is coupled to the bottom of the sink basin, and a lower end, which is coupled to the second side member of the first shelf member.

* * * * *